United States Patent [19]

DeLuca

[11] Patent Number: 4,741,704

[45] Date of Patent: May 3, 1988

[54] TAP CONNECTOR

[75] Inventor: Carlo B. DeLuca, Ormond Beach, Fla.

[73] Assignee: Homac Mfg. Company, Ormond Beach, Fla.

[21] Appl. No.: 25,704

[22] Filed: Mar. 13, 1987

[51] Int. Cl.[4] ..... H01R 13/648

[52] U.S. Cl. ..... 439/92; 439/477; 439/830; 439/861

[58] Field of Search ..... 439/92, 98, 100, 161, 439/477–480, 830–833, 839, 861, 862

[56] References Cited

U.S. PATENT DOCUMENTS

| | | | |
|---|---|---|---|
| 1,712,067 | 5/1929 | Bodendieck et al. | 439/479 |
| 2,105,884 | 1/1938 | Hanser et al. | 439/839 |
| 2,665,415 | 1/1954 | Kojis | 439/832 |
| 3,660,590 | 5/1972 | Conant | 174/47 |
| 4,038,489 | 7/1977 | Stenson et al. | 174/70 R |
| 4,153,332 | 5/1979 | Longoni | 350/96.23 |
| 4,365,865 | 12/1982 | Stiles | 350/96.23 |
| 4,371,234 | 2/1983 | Parfree et al. | 350/96.23 |
| 4,392,714 | 7/1983 | Bruggendieck et al. | 249/96.23 |
| 4,479,702 | 10/1984 | Pryor et al. | 350/96.23 |
| 4,491,387 | 1/1985 | Dey et al. | 350/96.23 |
| 4,494,822 | 1/1985 | Harvey | 240/96.21 |

OTHER PUBLICATIONS

"Positive Operation During Short-Circuit Stresses" G.E. Brochure, 3/1960.

*Primary Examiner*—John McQuade
*Attorney, Agent, or Firm*—John E. Benoit

[57] ABSTRACT

A tap connector for use with a range of conductor diameters having a yoke comprising a pair of opposed plates extending angularly from a pad. A flat spring is attached to the terminal ends of each of the plates and extends towards the pad and is spaced from the inner face of the plates a predetermined distance. The springs terminate in an arcuate configuration so as to accommodate the conductor under a predetermined constant pressure. The pad is connected to a ground cable. High amperages caused by lightning or short circuits create an electromechanical force which drives the terminal ends of the springs toward each other so as to provide higher mechanical pressure about the conductor under such fault conditions.

9 Claims, 4 Drawing Sheets

TAP CONNECTOR

This invention relates generally to tap connectors and, more specifically, to tap connectors which provide higher mechanical pressures about the conductor under fault conditions.

BACKGROUND OF THE INVENTION

The application and use of fiber optic cable in communications systems is standard practice with many major telephone companies. The advantages of usages in communication are well known.

More recently, electric utilities have developed an interest in cables which include a central core optic cable surrounded by standard electrical cable strands. Some of the major utilities have made such installations.

The cable configuration, including the central core optic cable, is similar to that disclosed by Dey et al in U.S. Pat. No. 4,491,387. In that configuration, Dey indicates a seamed tube as the housing for the optic cable. Cables presently in domestic use provide a seamless aluminum tube for this purpose. This cable structure, in essence, has a standard electrical cable functioning as a carrier for the fiber optic cable. There are two reasons why this conductor is being adopted by electric utilities. One is that they can use the fiber optic cable to monitor and control the performance of electrical equipment along electric lines. For example, the ampacity of power transformers at substations can be continuously monitored. Where ampacities exceed the maximum rating of the transformer, they can, through the use of a electronic and/or electrical control equipment, disconnect the transformers, thus preventing overloading and possible field failure.

A further reason for the use of such cables is that it allows the electric utilities to lease the excess fiber optic cable capacity to interested telephone companies.

Electrical connectors are now available for splicing and dead-ending such composite cable, including specially designed equipment to splice and terminate the fiber optic cable.

Making standard tap connections for grounding the electrical strands of this type of cable has posed a problem. Clamping pressure must be limited to prevent damage to the fiber optic cable. Conventional clamps now in common use for grounding do not limit the pressure applied to the conductors. Bolting torques now recommended for these clamps could collapse the aluminum tube which houses and protects the fiber optic cable.

Accordingly, one of the major objects of the present invention is to provide a conductor for grounding a cable which applies a predetermined constant pressure to the cable to avoid damage to the fiber optic cable while providing the necessary clamping pressure for good mechanical and electrical performance under fault conditions.

A further object is to provide a connector for grounding of cables which prevents damage to such cables having a central core optic cable.

A still further object is to provide a connector which is designed to accommodate a range of conductor diameters.

These, and other, objects of the invention will become apparent from the following description and associated drawings.

SUMMARY OF THE INVENTION

The present invention provides an electrical tap connector comprising a pad having a connecting means, such as a borehole therethrough, with a pair of opposed substantially rigid conductive plates extending from one end of the pad. Conductive spring means are secured to the terminal ends of the conductive plates and extend toward the pad at a predetermined distance from the plates. Means are provided at the terminal ends of the springs for supporting an electrical conductor between the springs. With this structure, a surge of high amperage caused by lightning strokes and short circuits induces an electromagnetic force between the springs and the associated plates so as to move the springs toward each other and increase the pressure on the conductor, thus holding the conductor within the connector.

DETAILED DESCRIPTION OF THE PREFERRED EMBODIMENTS

Figure 1:
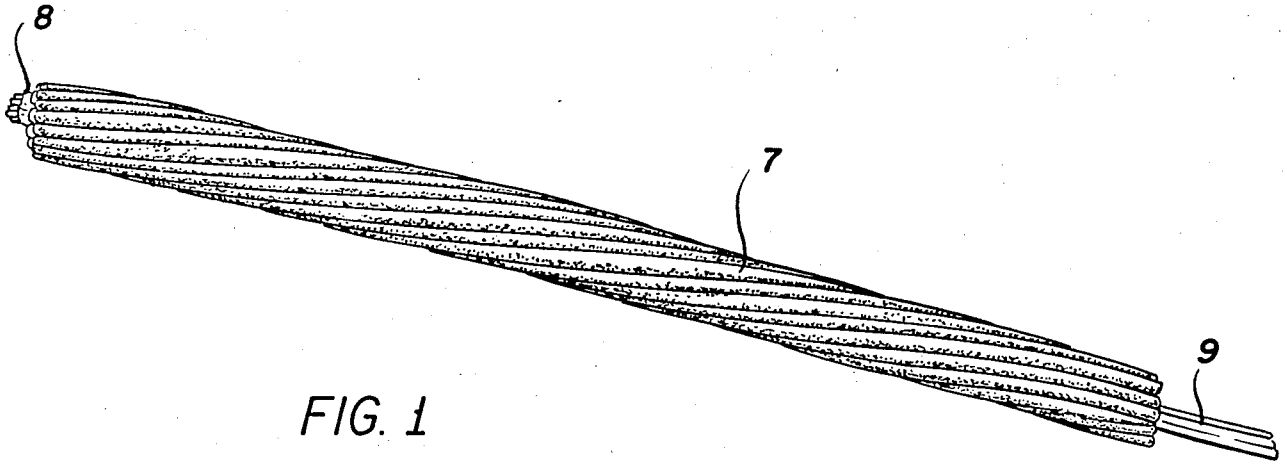
FIG. 1 is a perspective view of an electric strand cable having a central optic core.

Turning now to FIG. 1, there is shown an electric cable, including stranded conductor 7 and central core optic cable 9 with the optic cable being housed within seamless aluminum tube 8. This is one type of cable with which the connector of the present invention may be used.

Figure 2:
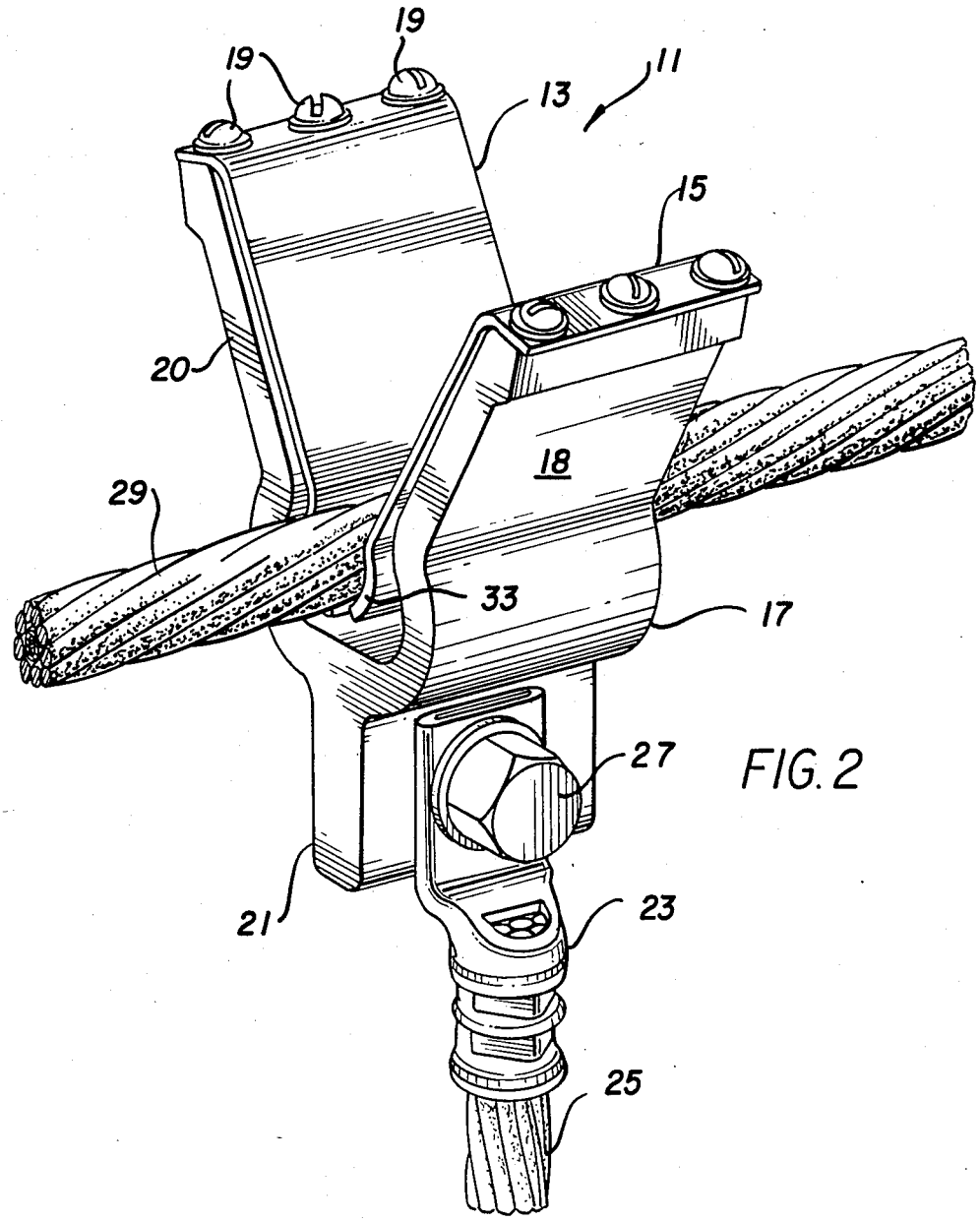
FIG. 2 is a perspective view of one embodiment of the present invention.

Referring to FIG. 2, there is disclosed connector 11 which includes flat springs 13 and 15 secured to substantially rigid yoke 17 by means of screws 19.

Yoke 17 includes angularly extending substantially flat conductive plates 18 and 20 which terminate at pad 21. Pad 21 provides a means for securing the connector to a ground cable. In the illustration shown, pad 21 is designed so as to accept compression terminal 23 of ground cable 25, which is secured to pad 21 by means such as a bolt 27 through borehole 28. It is to be understood that the connection may be made by other means, such as clamping or welding.

When connector 11 is in place, as shown in FIG. 2, stranded conductor 29 rests within the connector and is retained in position by arcuate end portions 31 and 33 of flat spring plates 13 and 15. While this connector is designed specifically for use with conductors including the central core optic cable such as shown in FIG. 1, it is to be understood that it could be used with any conductor.

Figure 3:
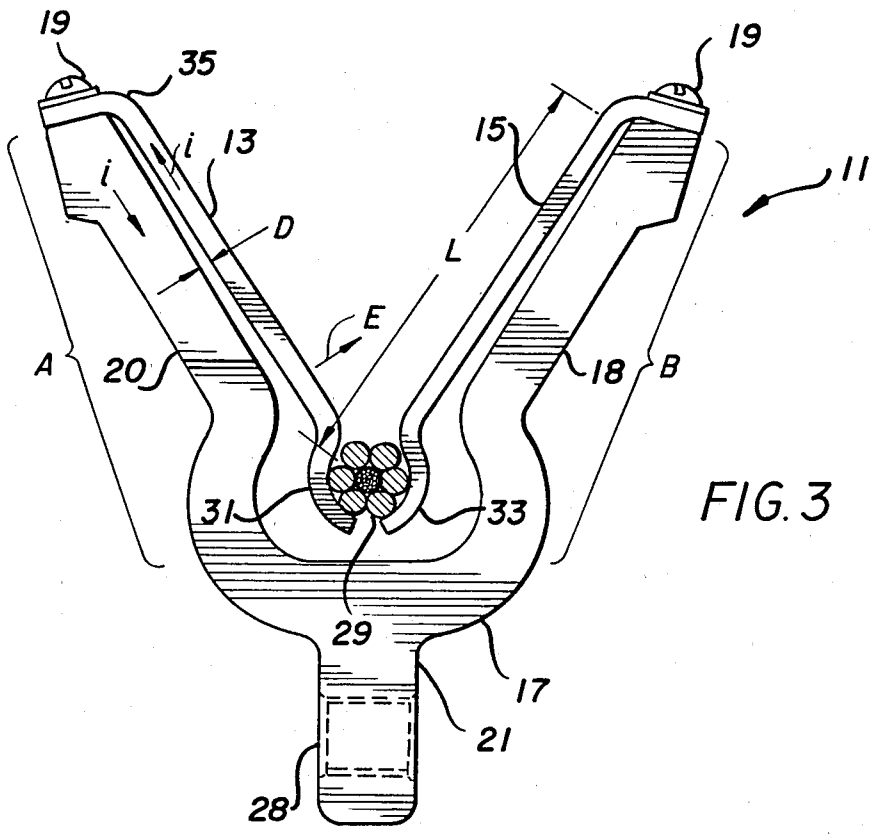
FIG. 3 is an end view of the connector of FIG. 2.

Turning to FIG. 3, the application of higher mechanical pressure about conductor 29 under fault conditions is shown.

Accepted factual theories concerning electromagnetic forces indicate that when two current paths are in close proximity to each other, and are travelling in exactly opposite directions, substantial magnetic forces are created. Under these conditions, the opposite forces repel each other, introducing mechanical forces between the two current paths. These forces are calculable based upon the square of the current involved, the distance between paths, the length of the opposite conductors, and other factors related to the size and shape of the conductors. While many references document this phenomena, reference is made to the *Standard Handbook for Electrical Engineering,* McGraw-Hill Book Company, Inc., 1949, Section 12, Paragraphs 511–518.

Referring to FIG. 3, the effect of such electromagnetic forces developed in the present tap connector design due to fault conditions is illustrated. One current path from the conductor to the ground occurs through flat spring 13, through the portion of the yoke designated as "A," through a pad 21 to the ground connector 25 (FIG. 2).

Flat springs 13 and 15 are similar dimensionally and in cross-sectional area, and the portions "A" and "B" of yoke 17 are also similar dimensionally and in cross-sectional area. Additionally, the spacing of flat spring 13 from the section "A" of yoke 13 and the spacing of flat spring 15 from the section "B" of the yoke 17 are substantially the same.

During assembly, compression terminal 23 is installed on ground wire 25 and is then bolted to pad 21 by means such as bolt 27. Line conductor 29 is assembled through flat springs 13 and 15, as shown in FIG. 2, which completes the connection.

The connector described above and shown in FIGS. 2 and 3 is designed to perform reliably when high amperages, caused by lightning strokes or short-circuits, must be grounded. The constant spring contact with the line conductor, as provided by the flat springs, cushions the mechanical thrusts commonly associated with these fault conditions. Any momentary expansion of the line cable, caused by the high ampacity involved, is absorbed by the spring contact shown. This expansion actually has the contact springs providing higher pressure against the line conductor than under normal static conditions.

The electromagnetic forces present under fault conditions, which develop the mechanical forces involved, are produced by the close proximity of flat spring 13 to plate 20 and flat spring 15 to plate 18. Since the electromagnetic forces involved in the relationship between the flat spring and the plate section are substantially identical, the following analysis, based upon the relationship of this flat spring 13 to plate 20, also applies to the relationship between flat spring 15 and plate 18.

Referring to FIG. 3, under fault conditions, a high ampacity electrical current is conducted through flat spring 13, in the direction indicated by the arrow. This high ampacity electric current continues through plate 20, in the direction indicated by a further arrow, through the lower yoke portion, pad 21, and to the ground connector (not shown). Accordingly, the current flowing through flat spring 13 and plate 20 are in opposing directions, and one member is in close proximity to the other, providing the conditions required to produce electromagnetic forces between the two elements.

Flat spring 13, therefore, is repelled by its opposing current path in plate 20. The resulting mechanical force initiates an inflection of flat spring 13, providing increased pressure about conductor 29 at its juncture with arcuate terminal end 31 of spring 13. As stated above, the same effect occurs in the other branch so as to increase the pressure applied to conductor 29 by arcuate terminal end 33 of spring 15. The fulcrum of this mechanical force is in the area of radius 35 of spring 13 and radius 37 of spring 15, while the pressure applied to conductor 29 is transmitted through a lever arm "L," as indicated in FIG. 3.

The pressure applied to conductor 29 by the mechanical force involved can, obviously, be varied by dimensional changes in the flat springs 13 and 15. A longer lever arm "L," as an example, would reduce the contact pressure about the conductor 29, while a shorter lever arm would increase such pressure. Since, as previously indicated, the mechanical forces developed by high ampacity fault conditions are calculable, the tap connector disclosed can be readily designed to accommodate a wide spectrum of fault currents with considerable accuracy. Obviously, it can also be adapted to various ranges of conductor diameters. This is of particular importance where fiber optic cable is involved, since it permits variance in the diameter of the central core which houses the fiber optic cable. An increase in the diameter of the central core would result in an overall increase in cable diameter. The connector of the present invention adapts to such variations, while connectors in use at the present time are limited to one conductor diameter.

Figure 4:
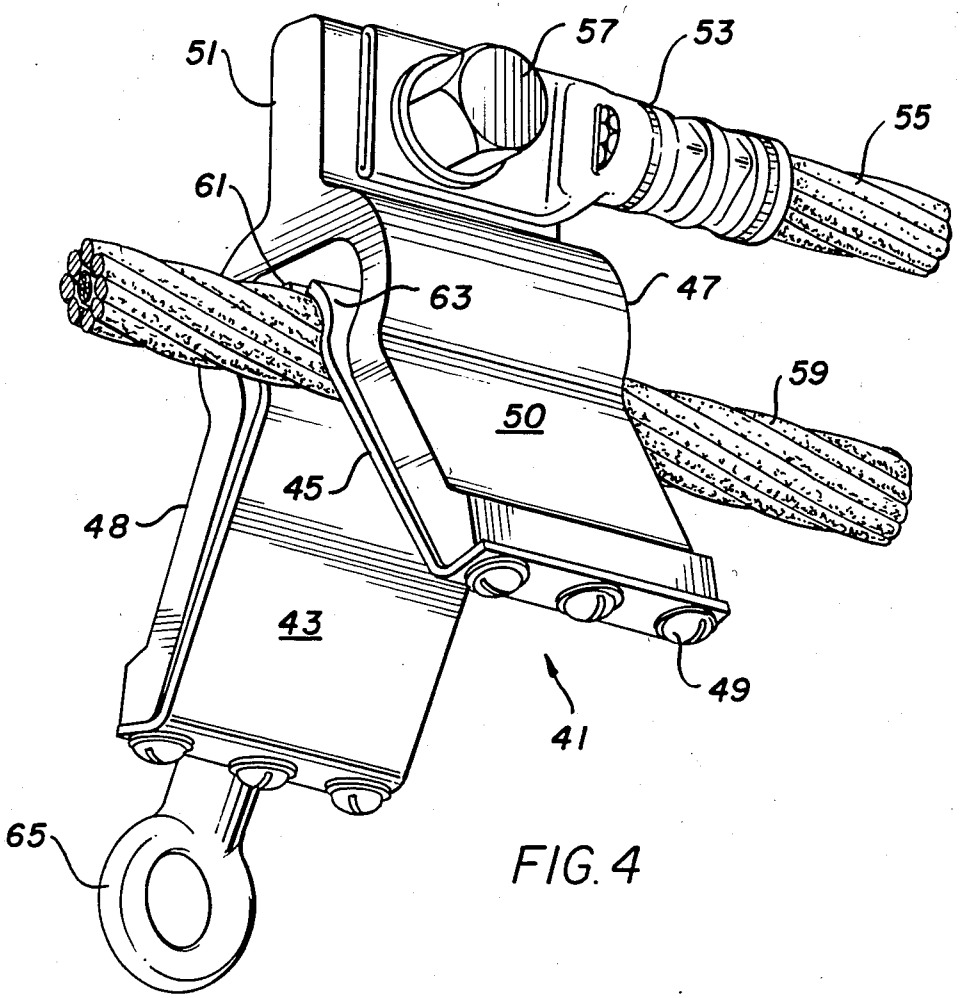
FIG. 4 is a modification of the connector of FIG. 2.

The connector of FIG. 4 is identical to the connector illustrated in FIG. 2, except that eye-bolt 65 is included in the connector by securing it to the connector by means such as welding or the like. Connector 41 includes flat springs 43 and 45 secured to substantially rigid yoke 47 by means of screws 49. Yoke 47 includes angularly extending substantially flat conductive plates 48 and 50 which terminate at pad 51. Pad 51 is designed so as to accept compression terminal 53 of ground cable 55, which is secured to pad 51 by means such as bolt 57. With connector 41 in place, as shown in the embodiment of FIG. 4, it rests on stranded main line line conductor 59 and is retained in position by arcuate end portions 61 and 63. Eye-bolt 65 is attached to plate 48 and extends below the connector as shown. This permits the use of insulated live line tools in making connections remotely to primary voltage lines where the voltage is higher than 5 KV. This protects the lineman, particularly where installations are made on energized lines. This practice is common on most electric utility systems.

In practice, the eye portion of eye-bolt 65 is installed rigidly in an insulated live line clamp stick, usually six- or eight-feet long, after installing the ground terminal to the ground cable, as discussed above. This subassembly is then lifted over main line 59 and snapped in place.

This quick engagement of the line conductor is particularly important where the line cable is energized. The drawing of an electric arc which could damage the connector and conductor is minimized. Bolted connections having rotatable eye-bolts for clamping conductors often draw arcs during installation as the clamping action is gradually applied.

While the description is directed to adapting the connector as a tap connector for grounding composite cable having a central fiber optic cable core, it is also applicable to standard electric cable that does not include the fiber optic cable.

Further, while the description relates to a tap connector in making ground connections, it is equally applicable for all tap connections. This would include connections to switches, lightning arrestors, primary fuse cutouts, and other line equipment in common use.

The above description and drawings are illustrative, only, since modifications as to geometric configurations could be varied without departing from the invention, the scope of which is to be limited only by the following claims.

I claim:

1. An electrical tap connector comprising a pad;

means for connecting said pad to a ground connector;

a pair of opposed substantially rigid conductive plates extending from one end of said pad;

substantially flat conductive spring means secured substantially to the terminal ends of said conductive plates and extending toward said pad at a predetermined distance from said plates; and means at the terminal ends of said springs for supporting an electrical conductor between said springs.

2. The connector of claim 1 wherein said means for supporting an electrical conductor between said springs comprises opposed arcuate terminal ends of said springs.

3. The connector of claim 1 further comprising an eye-bolt connected to and extending from one of said rigid conductive plates.

4. An electrical tap connector comprising a pad;

means for connecting said pad to a ground connector;

a pair of opposed substantially rigid conductive plates extending angularly from one end of said pad;

a flat conductive spring secured to the terminal end of each of said plates and extending towards said pad at a predetermined distance from the inner face of said associated plate; and means at the terminal end of said springs for supporting an electrical conductor.

5. The connector of claim 4 further comprising an eye-bolt secured to and extending from one of said plates.

6. The connector of claim 4 wherein said means for supporting an electrical conductor comprises opposed arcuate configurations at the terminal ends of said springs.

7. An electrical tap connector comprising a substantially rigid conductive yoke having a pad and a pair of opposed substantially rigid conductive plates;

means for connecting said pad to a ground connector;

opposed flat conductive spring means;

means for mounting said spring means to the terminal ends of said conductive plates and extending within said yoke at a predetermined spaced distance from said plates; and means on said spring means for retaining an electrical conductor therein;

said spring means being forced toward each other by an electromagnetic force when a high ampere electrical charge is conducted through said conductor.

8. The connector of claim 7 wherein said retaining means comprises opposed arcuate terminal ends of said spring means.

9. The connector of claim 7 further comprising an eye-bolt connected to and extending from said conductive yoke.

* * * * *